United States Patent [19]

Yang

[11] Patent Number: 4,537,433

[45] Date of Patent: Aug. 27, 1985

[54] AUXILIARY HANDLE FOR A SHOVEL

[76] Inventor: Sung H. Yang, 2764 Woodland Dr., Northbrook, Ill. 60062

[21] Appl. No.: 584,111

[22] Filed: Feb. 27, 1984

[51] Int. Cl.[3] ..... B25G 3/38

[52] U.S. Cl. ..... 294/58; 254/131.5

[58] Field of Search ..... 294/54.5, 57, 58, 59; 254/131.5

[56] References Cited

U.S. PATENT DOCUMENTS

| | | | |
|---|---|---|---|
| 584,827 | 6/1897 | McIndoo | 254/131.5 |
| 647,639 | 4/1900 | Vose | 254/131.5 |
| 702,097 | 6/1902 | Haviland | 294/58 |
| 766,933 | 8/1904 | Coon | 254/131.5 |
| 1,453,188 | 4/1923 | Ruppe | 294/58 |
| 3,136,574 | 6/1964 | Pasquale | 294/58 X |

FOREIGN PATENT DOCUMENTS

| | | | |
|---|---|---|---|
| 808505 | 7/1951 | Fed. Rep. of Germany | 294/59 |
| 817049 | 10/1951 | Fed. Rep. of Germany | 294/59 |
| 948860 | 8/1949 | France | 294/58 |

*Primary Examiner*—Johnny D. Cherry

*Attorney, Agent, or Firm*—Edward D. Gilhooly

[57] ABSTRACT

An auxiliary handle for a shovel and the like having a lever pivotally mounted beneath the axis of the shovel handle from a block attached to the handle. The lever member includes a pair of elongated handles disposed on opposite sides of the shovel handle and include an upper and lower grip to facilitate the lifting of the snow and the like. The auxiliary handle functions with the shovel to reduce the effort required in shoveling heavy material, such as snow or other items.

3 Claims, 7 Drawing Figures

AUXILIARY HANDLE FOR A SHOVEL

BACKGROUND OF THE INVENTION

This invention relates in general to shovels and scoops and, in particular, to an improved shovel or scoop having an auxiliary lifting handle.

More specifically, but without restriction to the particular use which is shown and described, the invention relates to an auxiliary handle for a shovel, such as used in removing snow and the like. The auxiliary handle is pivotally mounted beneath the longitudinal axis of the shovel handle to facilitate a shoveling action and to reduce the effort required for such tasks.

Shoveling material by a manual implement can be arduous work, particularly when heavy snow is being removed. As is well known, conventional snow shovels employ a scoop at one end supported by a handle structure. The user of the shovel must not only support heavy loads, but must also resist the torque about the axis of the handle due to the material being lifted. The use of a conventional shovel for removing snow is capable of adversely effecting the user's back and other areas of his body. Automated snow removers have been introduced to alleviate the strain and physical effort of removing snow. These machines, however, are expensive to manufacture and purchase, are noisy in operation, and can be awkward in moving from place to place.

One attempted solution to the foregoing problems has been to employ an auxiliary handle with a standard shovel design. Such auxiliary handles are shown in U.S. Pat. No. 4,128,266 to Vaslas; U.S. Pat. No. 344,890 to Wilson; U.S. Pat. No. 702,097 to Haviland; and U.S. Pat. No. 715,056 to Gruner. Such prior designs for auxiliary handle to shovels have proved to be unsatisfactory in operation. These techniques have functioned to be no more than an extension of the handle, while offering little reduction in the loads and torques encountered during a shoveling task.

SUMMARY OF THE INVENTION

It is therefore an object of the present invention to provide an improved shovel or scoop.

A further object of the invention is to reduce the effort required in manually shoveling snow or other material.

A further object of the invention is to provide an auxiliary handle for a shovel capable of reducing the loads experienced by the user.

A still further object of this invention is to increase the efficiency of a shoveling operation while subjecting the user to minimum physical stress.

Another object of this invention is to increase the shoveling capability of a manual implement.

These and other objects are attained in accordance with the present invention wherein there is provided an auxiliary handle for a shovel and the like. The auxiliary handle of the invention is adjustably mounted on the handle of a typical shovel design. The auxiliary handle comprises a lever means pivotally mounted along a pivot axis lying beneath the longitudinal axis of the handle of the shovel. The auxiliary handle of the invention is provided with two gripping elements to increase the versatility of the device during use. The invention of the application not only reduces the loads to which the shoveler is subjected, but also prevents injuries to the user's back or other parts of the body while working.

BRIEF DESCRIPTION OF THE DRAWINGS

Further objects of the invention, together with additional features attributing thereto and advantages accruing therefrom, will be apparent from the following description of a preferred embodiment of the invention which is shown in the accompanying drawings with like reference numerals indicating corresponding parts throughout; wherein.

DESCRIPTION OF A PREFERRED EMBODIMENT

Figure 1:
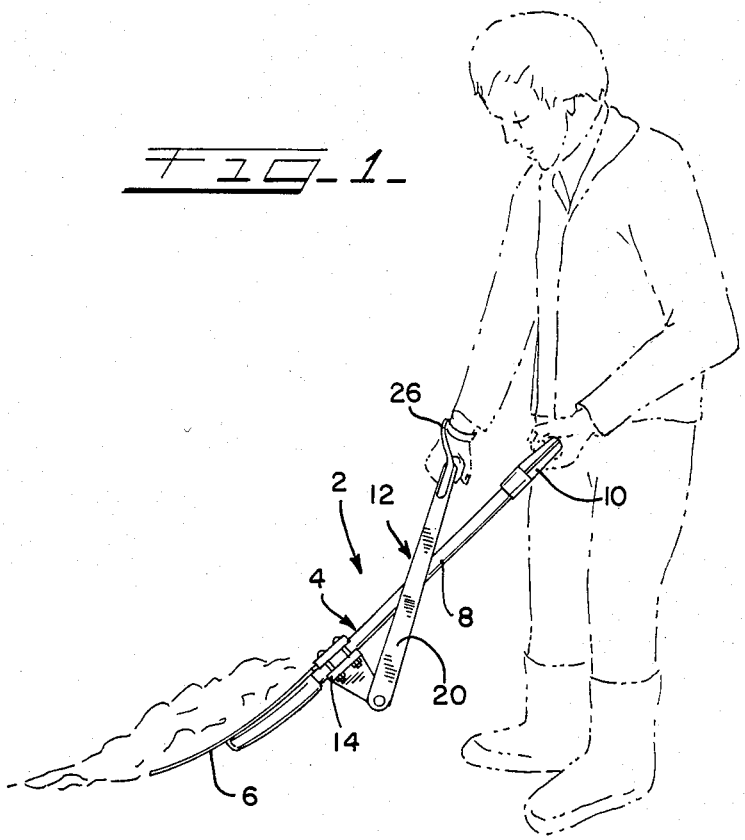
FIG. 1 is a perspective view of the auxiliary handle for a shovel showing a user in phantom.

Referring now to FIG. 1, there is illustrated a user operating the auxiliary handle for a shovel of the invention, generally designated as shovel handle assembly 2. The assembly 2 includes a conventional shovel 4 having a lower metal or plastic scoop or blade 6 of a known design. Although the scoop or blade 6 can be found in other configurations, it is shown in FIG. 1 as having a design commonly used in snow shovels. The blade or scoop 6 is supported at one end of a long handle member 8 which is fabricated from wood, plastic, or a metal and is provided with a typical hand grip 10 at its opposite end.

Figure 6:
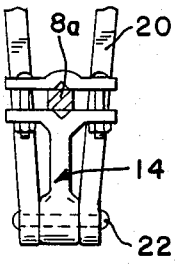
FIG. 6 is a partial schematic view, with parts in section, of an alternative handle configuration of a shovel.
Figure 7:
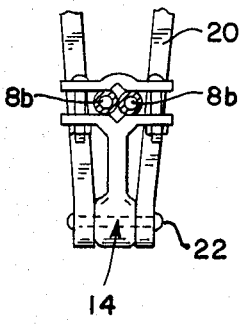
FIG. 7 is a partial schematic view, with parts in section, of still another alternative configuration of a shovel handle with which the invention of the application may be used.

Although the shovel in FIGS. 1–5 is illustrated as having a cylindrical handle member, the invention of the application can be used with a main handle of other cross sectional shapes such as a rectangular configuration, as handle 8*a* in FIG. 6, or a dual cylindrical configuration, as handle 8*b* in FIG. 7, and the like.

The main handle 8 is arranged to support the auxiliary handle of the invention, generally designed by reference numeral 12. The auxiliary handle assembly 12 is supported by means of a mounting block 14 that includes a projecting portion 14*a* (FIG. 5) that extends beyond the axis of the handle 8. The end section 14*b* of the mounting block is formed with a hole to create a pivot axis of the auxiliary handle 12, as will be apparent. The mounting block member 14 is retained on the handle 8 in conjunction with a cross member 16, such that the cross member 16 and oppositely disposed portions 14*c* of the block 14 are affixed together by threaded bolt members 18. By loosening the threaded bolt members 18, the mounting block 14 can be adjusted along the length of the handle member 8 to accommodate any height of user and encountered conditions.

Figure 2:
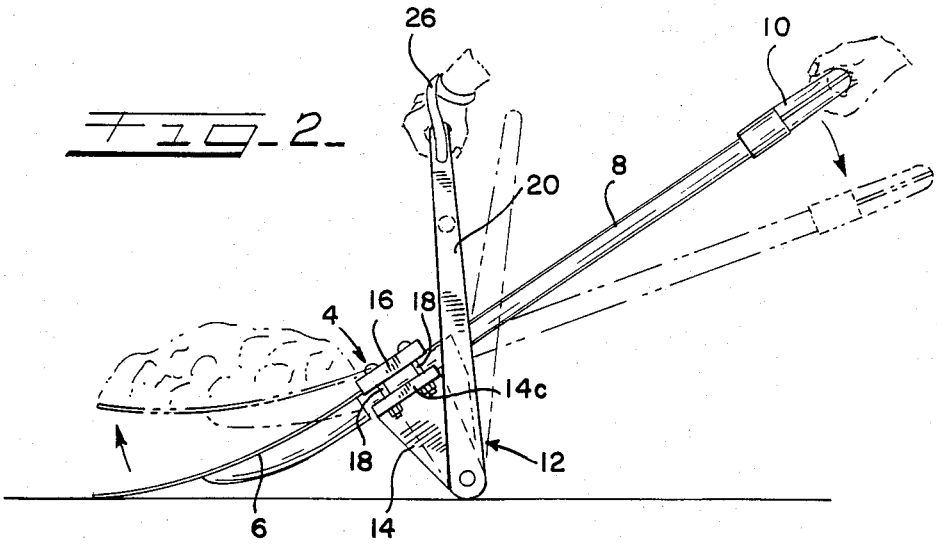
FIG. 2 is a side schematic view of the auxiliary handle for a shovel of FIG. 1 showing operative movement of the device in phantom.
Figure 3:
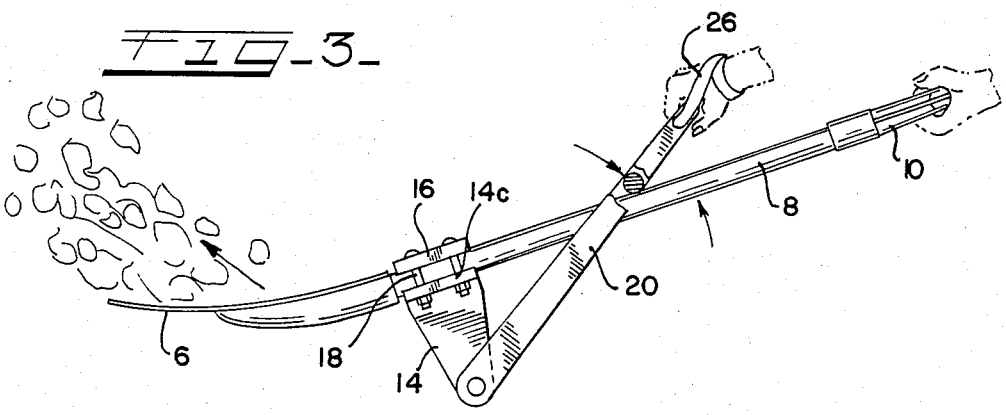
FIG. 3 is a side schematic view of the auxiliary handle for a shovel of FIG. 2 in a second operative position.
Figure 4:
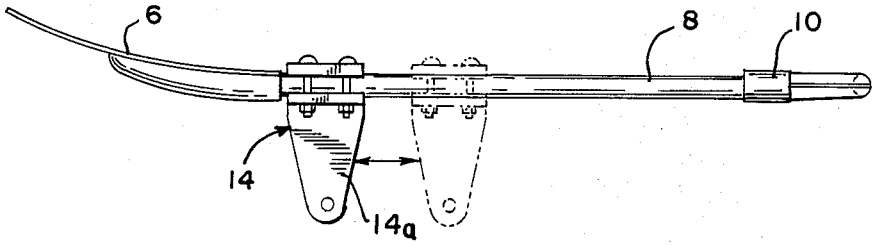
FIG. 4 is a side schematic view of the auxiliary handle for a shovel of FIG. 2 showing the adjustability of the mounting block in phantom.
Figure 5:
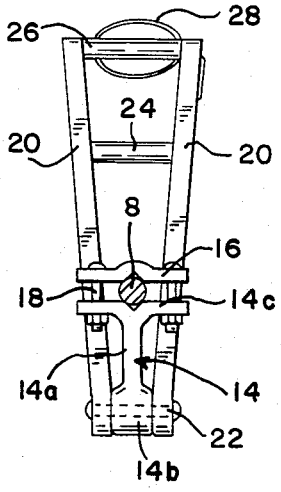
FIG. 5 is an end schematic view, with parts in section, of the auxiliary handle for a shovel of FIG. 2.

The auxiliary handle assembly includes a pair of spaced handle members 20 which are positioned on opposite sides of main handle 8 and pivotally affixed to block 14 by bolt 22 extending through the hole of the block. The two auxiliary handle members 20 are coupled at their end opposite from the pivot axis of pin 22 by intermediate hand grip 24 and upper hand grip 26. A flexible hand strap 28 may be affixed to the auxiliary handle member 20 adjacent upper hand grip 26 to aid in manipulating the assembly 20 as shown in FIGS. 1, 2 and 3. As seen in FIG. 3, the intermediate grip 24 can also function as a stop to maintain the auxiliary handle in a scissor-like relationship with the axis of the shovel handle 8. As is apparent from FIGS. 2 and 3, the user may either grasp the intermediate grip or the upper grip 26 of the auxiliary handle in one hand, and the hand grip 10 of the shovel in the other. The pivot axis of the auxiliary handle assembly 20 is disposed on the opposite side of the longitudinal axis of the main handle 8 from the position of gripping of the user.

As shown in FIG. 2, the user may lift a shovel full of material by pushing down on handle 8 by creating a fulcrum on the block 14 and lifting the material up with a reduction of the load. The physical position of the upper grip 26 and hand grip 10 permits the load to be lifted with minimum bending, i.e. 20° or less, as compared to 90° for a standard shovel. The lifting effort of the invention of the application requires less than 50% of the force of a conventional shovel and permits a wider blade to be used, because the torque encountered by the user is reduced considerably. By using the wrist holding band, firm grasping of the handle is not required. When lifting the snow from the ground, the striking impact of the intermediate grip 24 against the main handle 8 vibrates the load in a manner to dispose of or dislodge the snow and the like from the scoop 6 after being lifted. As an illustration of additional uses of the invention, the upper grip 26 might be grasped when the snow is 6 inches or less; while if the snow is higher and the user is presented with a pile of 10 inches, it may be convenient to use the intermediate grip 24.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A shovel assembly having an auxiliary handle comprising an elongated main handle having a blade at one end and a hand grip at its opposite end;

an auxiliary handle means being affixed to said main handle;

said auxiliary handle means having a mounting member for affixing said auxiliary handle means to said main handle;

said auxiliary handle means further having a pair of integrally connected handle members, pivotally attached to said mounting member and extending in crossing relationship to said main handle;

said handle members being pivotally mounted about a pivot axis lying beneath the longitudinal axis of said main handle during use;

said pair of handle members are interconnected adjacent one end portion by an upper grip; and said pair of handle members are further interconnected by an intermediate grip member, said intermediate grip member further acting as a stop for said pair of handle members and as a striker member to jar material from said blade.

2. The assembly according to claim 1 wherein said mounting member is mounted for selective adjustable movement along said main handle.

3. The assembly according to claim 1 wherein said pair of handle members are pivotally mounted adjacent their end portion opposite to said one end portion, said mounting member having one end portion for forming a fulcrum for the shovel assembly beneath said main handle during use, the opposite end portion of said mounting member having an enlarged surface disposed adjacent said main handle and having a width greater than the cross-sectional dimension of said main handle, a retention member disposed on the opposite side of said main handle from said enlarged surface and is confronting relationship to said main handle, retention elements extending between said enlarged surface and said retention member to retain the mounting member to said main handle having a plurality of cross-sectional configurations, said retention elements further permitting adjustment of said mounting member relative to said main handle.

* * * * *